United States Patent [19]

Revels

[11] 4,234,975

[45] Nov. 25, 1980

[54] WATER DISTRIBUTOR FOR TOILET BOWLS

[76] Inventor: Jewel W. Revels, Rte. 2, Box 446, Rockwood, Tenn. 37854

[21] Appl. No.: 32,788

[22] Filed: Apr. 23, 1979

[51] Int. Cl.[3] ..... E03D 3/00; E03D 9/02; E03D 11/00; B05B 1/26

[52] U.S. Cl. ..... 4/300; 4/231; 4/420; 239/498

[58] Field of Search ..... 4/1, 9, 261, 181, 262, 4/231, 300, 310, 309, 311, 301, 420, 421, 422, 415, 145, 150, 191, 195; 239/498

[56] References Cited

U.S. PATENT DOCUMENTS

| | | | |
|---|---|---|---|
| 927,132 | 7/1909 | Duenwald | 4/231 |
| 1,136,268 | 4/1915 | Reamer | 4/231 |
| 1,904,292 | 4/1933 | Duncan | 239/498 X |
| 2,214,798 | 9/1940 | Reikosky | 4/231 |
| 3,212,106 | 10/1965 | Noel | 4/421 |
| 4,006,497 | 2/1977 | Möllerstedt | 4/420 X |
| 4,106,131 | 8/1978 | Delker | 4/420 X |

FOREIGN PATENT DOCUMENTS

| | | | |
|---|---|---|---|
| 464648 | 4/1937 | United Kingdom | 4/231 |

*Primary Examiner*—Stuart S. Levy
*Attorney, Agent, or Firm*—Martin J. Skinner

[57] ABSTRACT

A device is described which, when inserted under the rim of a toilet bowl in contact with the side wall thereof, uniformly distributes water over the surface of the bowl walls. This aids flushing material from the toilet. In many types of toilets, this also reduces the quantity of water required for each flushing operation. The device is flexible whereby installation and removal are facilitated in any shape of conventional toilet bowl.

3 Claims, 5 Drawing Figures

WATER DISTRIBUTOR FOR TOILET BOWLS

BACKGROUND OF THE INVENTION

Each time a tank-type toilet is flushed, six to eight gallons of water go through the bowl and down the drain. The flushing of a toilet, in fact, consumes almost one half of the water used each day by a typical household—about 29 gallons of water per person is one estimate of the quantity. Because energy demands, and costs associated with water processing have increased substantially, there now exists a need to reduce the quantity of water used in all applications, including the flushing of toilets.

Numerous systems and devices have been proposed, and promoted, for reducing the amount of water used per flush of the toilet. These include smaller tanks, special valves, etc., all of which relate to controlling the amount of water entering the bowl. A review article describing typical devices, and their relative effectiveness, appears in Consumers Reports ©, May 1979, beginning on page 296.

Whenever the volume of water dispensed into the bowl becomes too small, improper flushing occurs. By observation, I have determined that this is aggravated by the manner of distribution of water to the bowl surface, especially if non-uniform distribution occurs. Also, effective flushing action is reduced by swirling motion of water and waste against the bowl surface.

SUMMARY OF THE INVENTION

My water distributor for toilet bowls comprises a flexible, elongated channel element to be placed beneath the toilet rim in contact with the walls of the toilet bowl, this element having uniformly positioned, substantially annular external ridges whereby the space between the ridges directs water uniformly over the bowl surface.

BRIEF REFERENCE TO DRAWINGS

DETAILED DESCRIPTION

Figure 1:
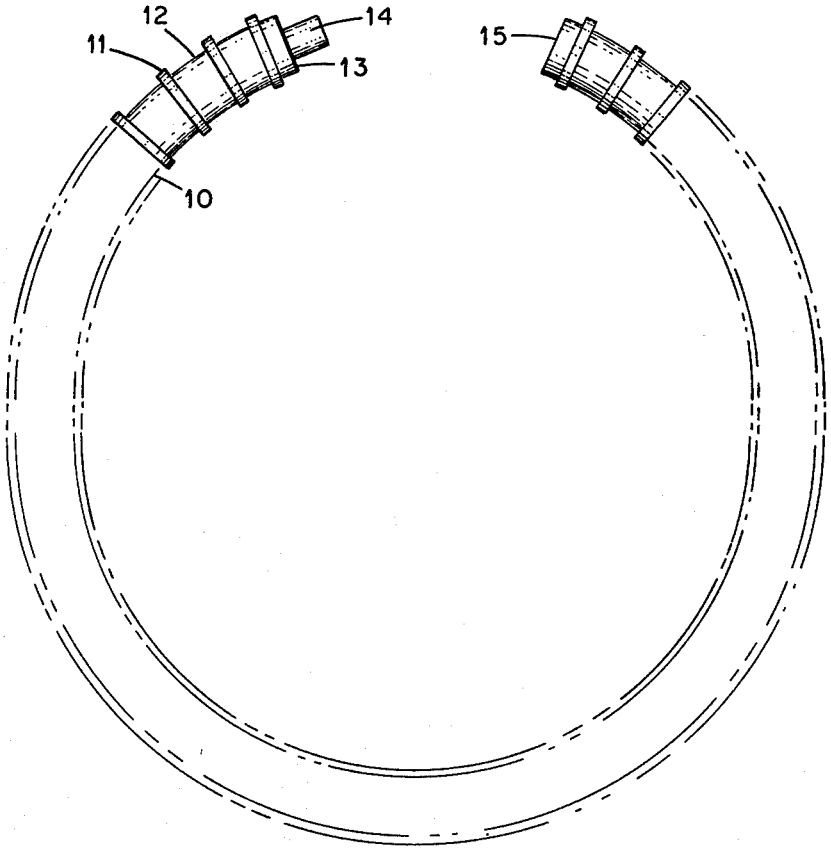
FIG. 1 is a drawing of my water distributor prior to insertion into a toilet bowl.

The simplicity of my water distributor is illustrated in FIG. 1. In this embodiment, a hollow cylindrical tubing 10 has, extending radially from its surface, uniformly spaced annular ridges 11. These ridges create valleys 12 therebetween, having walls substantially perpendicular to tubing 10, whose function is described hereinafter. Preferably, the ridges are integral with the tubing. The distributors are fabricated from a plastic having flexibility as a result of the composition and the ridged structure. A commercial ribbed tubing of an appropriate type is polyethylene "Corrtube" manufactured by O.E.M. Corp., Itasca, Ill.

One end 13 of the tubing 10 is closed with a plug 14 that extends whereby it may be inserted into the second end 15 of the tubing to form a closed loop. The length along the outer portion of the loop is made equal to the peripheral dimension of a toilet bowl immediately adjacent the rim. Different styles and makes of toilet bowls have different dimensions; therefore, the tubing length is determined for the particular unit before being joined into the loop and inserted into the toilet bowl. A typical length is about 110 cm.

Figure 2:
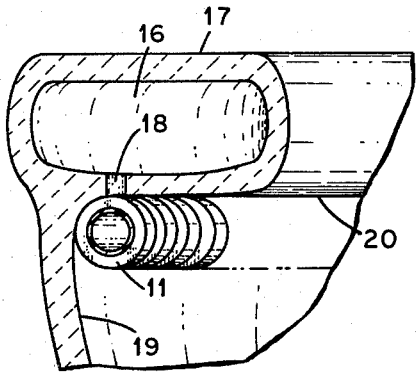
FIG. 2 is a cross section, as cutaway, showing my water distributor in position in a toilet bowl.

Installation of my water distributor is shown in FIG. 2. Although bowls differ in detail, each type of toilet bowl has a water supply channel 16 within a rim 17. Small openings 18 communicate between this supply channel 16 and an inner surface 19 of the toilet bowl. The rim projects inward from this inner surface 19 forming an overhang having a bottom surface 20, as shown. My distributor fits immediately beneath the rim 17 whereby the annular ridges 11 are in contact with the bottom surface 20 and the inner bowl surface 19. As a result, the valleys 12 (see FIG. 1) serve as channels to downwardly direct water, entering through openings 18, uniformly over the inner bowl surface 19.

When properly positioned, as shown in this figure, the distributor is well above any waste in the bowl. Furthermore, it is not visible and therefore the color need not match that of the bowl. Because of its flexibility, however, it may be removed for complete cleaning of the bowl.

Figure 3:
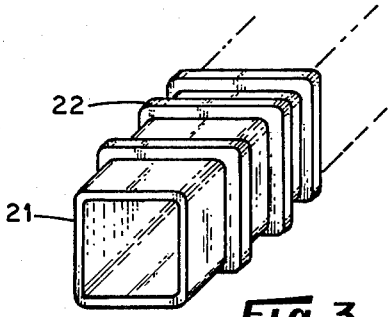
FIG. 3 is a drawing of another embodiment of my water distributor.
Figure 5:
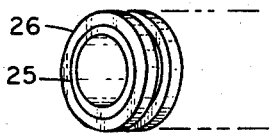
FIGS. 4 and 5 are drawings of still other embodiments of my invention.
Figure 4:
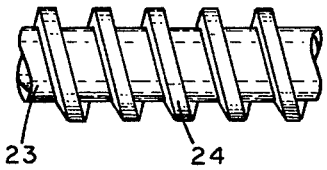

Other embodiments of my water distributor are depicted in FIGS. 3–5. In FIG. 3, the central channel 21 is substantially rectangular (e.g., square) in cross section, with the annular ridges 22 of like configuration (circular ridges could be used). FIG. 4 shows an embodiment wherein a cylindrical channel 23 is provided with an outwardly projecting spiral ridge 24 to perform a function similar to the ridge-valley construction of FIGS. 1 and 3. The embodiment in FIG. 5 utilizes an oval channel 25, the minor axis to be positioned perpendicularly to the bowl surface, having ridges 26 of uniform height.

The above-described embodiments indicate a hollow central channel. This is not a requirement of my invention although it does facilitate joining the ends (as in FIG. 1). For example, a solid core may create a spring-type effect to maintain the water distributor in proper position beneath the rim. This would eliminate joining the ends of the distributor.

The choice of materials of construction are primarily governed by the water environment: the properties of the material should not be affected by the frequent contact with household water and its common constituents. Suitable materials are ABS plastic, nylon, polypropylene, polyethylene, and like substances.

The dimensions of my distributor do not significantly influence performance when they are within certain limits. The afore-mentioned corrugated tubing, "Corrtube", that I utilize has an outside diameter of about 18 mm. The ridges are about 2 mm wide and are spaced apart about 1 mm. The depth of the valley is about 1.5 mm. Distributors of outer diameter less than about 10 mm are less effective for two reasons: some water entering through openings 18 may flow over the inner surface of the distributor; and the distributor may not have sufficient resiliency to maintain proper position within the bowl. Distributors of greater diameter may be used, with an upper limit of about 20 mm set by the appearance in the bowl since the overhang on bowls is 20–30 mm.

Ridges and valleys (corrugations) of the above dimensions are near the minimum as smaller channels would give excessive resistance to water flow. An upper range is near 5 mm for the ridge and valley width, as well as the valley depth. Larger dimensions will not overcome the swirling action in those bowls where the openings 18 are oriented to produce the same. Also, water may flow over the inner surface of the distributor and negate its function.

My water distributor assists in reducing the quantity of water used for flushing at least some types of toilets. In particular, considerable water velocity is lost in some bowls by the swirling of the water over the surface of the bowl. This loss of velocity is normally compensated for by using an additional quantity of water to properly clear the bowl of solids. My distributor orients the water flow more directly toward the outlet whereby a smaller quantity of water is required for adequate flushing action. As much as a 20% reduction in water has been demonstrated in a toilet of this type. Accordingly, the water storage tank of the toilet may be modified to hold a smaller volume of water for each flushing operation. Devices such as described in the aforementioned Consumer Reports reference may be used for the volume reduction.

From the foregoing it may be seen that my water distributor for toilets is simple, easily installed and effective to uniformly direct water down the inside of the toilet bowl. For many toilets, this redistribution of water substantially reduces the quantity of water needed to adequately flush the toilet.

I claim:

1. In a combination with a toilet bowl a water distributor for toilet bowls to be inserted immediately beneath the rim thereof in contact with the inner bowl surface and the lower surface of the toilet bowl rim for redistributing water entering under the rim to achieve non-swirling motion of the water vertically downward across all of the bowl surface, which comprises:

a flexible elongated core having an uninterrupted length substantially equal to the perimeter of the bowl under the rim, and a uniform cross section throughout the length;

a plurality of equally spaced ridges on the surface of the elongated core, the ridges extending a uniform distance outward from and around the elongated core thereby forming channels for redistributing the water vertically downward over all of the bowl surface; and wherein the elongated core and the ridges are integrally and unitarily formed of a material inert to fluids present in the bowl, wherein the outward extending distance of the ridges is about 10 to 20 mm, the ridges are about 2 to 5 mm wide and 1.5 to 5 mm high, and the spacing between the ridges is about 1 to 5 mm.

2. The water distributor of claim 1 wherein the elongated core is provided with a hollow bore, and further comprises a plug element inserted in the bore at each end thereof thereby joining ends of the elongated core into a ring-shaped configuration.

3. The water distributor of claim 2 wherein the elongated core is a hollow right circular cylinder, and wherein the ridges are annular.

* * * * *